US007086128B2

(12) United States Patent
Smith

(10) Patent No.: US 7,086,128 B2
(45) Date of Patent: Aug. 8, 2006

(54) SEAM ASSIST ATTACHMENT DEVICE

(75) Inventor: Richard Wayne Smith, Travelers Rest, SC (US)

(73) Assignee: Albany International Corp., Albany, NY (US)

( * ) Notice: Subject to any disclaimer, the term of this patent is extended or adjusted under 35 U.S.C. 154(b) by 560 days.

(21) Appl. No.: 10/331,021

(22) Filed: Dec. 27, 2002

(65) Prior Publication Data

US 2004/0224105 A1 Nov. 11, 2004

(51) Int. Cl.
*F16G 3/16* (2006.01)

(52) U.S. Cl. ..... 28/142; 24/31 V; 24/33 R

(58) Field of Classification Search ..... 28/142, 28/171, 100, 141; 24/31 R, 32, 33 R, 33 A, 24/31 V, 33 P, 33 K, 38, 31 B, 31 H; 492/48, 492/57, 60; 474/255, 256, 257, 258; 198/844.2, 198/848; 162/358.1, 358.2, 199; 139/383 R, 139/384 R, 387 R See application file for complete search history.

(56) References Cited

U.S. PATENT DOCUMENTS

| | | | | | |
|---|---|---|---|---|---|
| 3,581,348 | A * | 6/1971 | Lister | 24/31 H |
| 4,035,872 | A * | 7/1977 | MacBean | 24/31 H |
| 4,567,077 | A | 1/1986 | Gauthier | |
| 4,842,925 | A * | 6/1989 | Dufour et al. | 428/223 |
| 4,972,561 | A * | 11/1990 | Aldrich | 28/142 |
| 5,015,220 | A * | 5/1991 | Legge et al. | 474/256 |
| 5,067,217 | A * | 11/1991 | Maguire | 492/48 |
| 5,419,017 | A * | 5/1995 | Buchanan et al. | 24/33 R |
| 5,632,701 | A * | 5/1997 | Neel | 474/256 |
| 5,732,749 | A | 3/1998 | Fargeout | |
| 5,915,422 | A | 6/1999 | Fagerholm | |
| 6,001,443 | A * | 12/1999 | Holden et al. | 428/61 |
| 6,194,331 | B1 | 2/2001 | Elkins | |
| 6,265,048 | B1 * | 7/2001 | Rydin et al. | 428/121 |

FOREIGN PATENT DOCUMENTS

| | | |
|---|---|---|
| EP | 0 274 244 A | 7/1988 |
| EP | 0 332 146 A | 9/1989 |
| EP | 0367614 A2 * | 5/1990 |
| EP | 0 489 557 A | 6/1992 |
| WO | WO 97/20105 | 6/1997 |

* cited by examiner

*Primary Examiner*—A. Vanatta
(74) *Attorney, Agent, or Firm*—Frommer Lawrence & Haug LLP; Ronald R. Santucci

(57) ABSTRACT

A method of assisting in the seaming of a papermaker's fabric using a seam assist device is disclosed. The seam assist device is comprised of two portions. Each portion having an attaching edge that is attached to a predetermined distance from the ends of the fabric by fitting spiral or loop elements into voids in the surface of the fabric and anchoring the elements using a binder or pintle. Connecting edges on each portion are then connected together, thereby causing the two attached ends of the fabric to be brought together for seaming.

21 Claims, 3 Drawing Sheets

SEAM ASSIST ATTACHMENT DEVICE

BACKGROUND OF THE INVENTION

1. Field of the Invention

The present invention relates to the papermaking arts. More specifically, the present invention relates to a seam assist device for pulling together and aligning two ends of a papermaker's fabric for seaming on a paper machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

Woven fabrics take many different forms. For example, they may be woven endless, or flat woven and subsequently rendered into endless form with a seam. Woven fabrics are typically in the form of endless loops, or are seamable into such forms, having a specific length, measured longitudinally therearound, and a specific width, measured transversely thereacross. Because paper machine configurations vary widely, paper machine clothing manufacturers are required to produce fabrics, and other paper machine clothing, to the dimensions required to fit particular positions in the paper machines of their customers. Needless to say, this requirement makes it difficult to streamline the manufacturing process, as each fabric must typically be made to order.

Fabrics in modern papermaking machines may have a width of from 5 to over 33 feet, a length of from 40 to over 400 feet and weigh from approximately 100 to over 3,000 pounds. These fabrics wear out and require replacement. Replacement of fabrics often involves taking the machine out of service, removing the worn fabric, setting up to install a fabric and installing the new fabric. While many fabrics are endless, about half of those used in press sections of the paper machines today are on-machine-seamable. Some Paper Industry Process Belts (PIPBs) are contemplated to have an on machine seam capability, such as some transfer belts, known as Transbelt®. Installation of the fabric includes pulling the fabric body onto a machine and joining the fabric ends to form an endless belt.

In brief, the seam region of any workable fabric must behave under load and must have the same permeability to water and to air as the rest of the fabric, in order to prevent the periodic marking of the paper product being manufactured by the seam region.

Despite the considerable technical obstacles presented by these requirements, it is highly desirable to develop seamable fabrics, because of the comparative ease and safety with which they can be installed.

To facilitate seaming, many current fabrics have seaming loops on the crosswise edges of the two ends of the fabric. The seaming loops themselves are formed by the machine-direction (MD) yarns of the fabric. A seam is formed by bringing the two ends of the fabric press together, by interdigitating the seaming loops at the two ends of the fabric, and by directing a so-called pin, or pintle, through the passage defined by the interdigitated seaming loops to lock the two ends of the fabric together.

Alternatively, a monofilament seaming spiral may be attached to the seaming loops at each of the two ends of the papermaker's fabric. The monofilament seaming spirals are connected to the seaming loops by at least one connecting yarn. The coils of the spirals at the two ends of the fabric may then be interdigitated and joined to one another on the paper machine to form a seam usually referred to as a spiral seam.

In a so-called warp loop seam, the rows of loops are formed of extended edge loops of warp yarns in the fabric structure of the fabric. In a so-called spiral seam, each row of loops is instead formed of a separate, preformed yarn spiral, which is extended along and attached by means of a CD pintle connecting the spiral, intermeshed with the machine direction yarns, such as warp yarns, to the seam edge of the fabric. Alternatively, the spiral can be attached to the clothing by a number of cross-machine direction yarns being raveled a distance from the seam edge, whereupon the loops of the spiral are inserted into the thus formed looser edge portion. Then the edge is folded back over itself and is attached to the clothing, for instance, by using a sewing machine. Independently of how the spiral is attached, the clothing comprises two spirals, one along each seam edge, which, when joining together the fabric, are meshed with each other like a zipper so as to be joined together by means of a pintle wire or the like.

Alternatively, fabrics can be formed completely of spirals as taught by Gauthier, U.S. Pat. No. 4,567,077; which is incorporated herein by reference. In this case, the spirals are connected to each other by at least one connecting pin. In theory, the seam can therefore be at any location in the fabric body where a connecting pin may be removed. The best known advantage of a spiral fabric versus a woven fabric is the seam is geometrically similar to the fabric body.

A seam is generally a critical part of a seamed fabric, since uniform paper quality, low marking and excellent runnability of the fabric require a seam which is as similar as possible to the rest of the fabric in respect of properties such as thickness, structure, strength, permeability etc.

An important aspect of seaming a fabric on a paper machine is that there be uniform tension across the fabric. If uniform tension is not achieved and one section of the fabric pulls more than another, then the fabric can bubble or ridge across the fabric width.

Another aspect of seaming a fabric is preventing damage to the fabric body. In order to avoid or minimize the chance of damage to the fabric during installation, non-uniform tension, weight and pressure must be avoided on the seam itself.

It has been common practice to attach zippers and VELCRO®or hook and loop type assists to fabrics by use of staples, sewing and/or adhesive materials. However, since these attachment methods can damage the fabric surface, it is preferable to use methods which do not damage the fabric.

A further aspect of seaming a fabric, especially very long ones is properly aligning the fabric body in the machine so the fabric guides true in the machine direction and does not oscillate or track to one side of the machine. If the fabric guides or tracks poorly it can make contact with the paper machine support frame and cause fabric damage.

SUMMARY OF THE INVENTION

The present invention is a device for assisting in the seaming of papermaking fabrics. The device provides a solution to the problem of producing a uniform seam by reducing tension and aligning the fabric ends without damaging the fabric in the seam area.

It is therefore an object of the invention to overcome the above mentioned problems when seaming a papermaking fabric.

It is a further object of the invention to provide a device for seaming a fabric which attaches using voids in the fabric surface.

Accordingly, the present invention is a method of assisting in the seaming of a papermaker's fabric using a seam assist device. The invention attaches a first attaching edge of a first portion of the seam assist device to the fabric in the crossmachine direction and a first distance in the machine direction from a first end of the fabric. A second attaching edge of a second portion of the seam assist device is attached to the fabric in the cross-machine direction and a second distance in the machine direction from a second end of the fabric. The first and second attaching edges having spiral or loop elements which are fit into voids in the surface of the fabric and anchored using a pin or pintle. A first connecting edge of the first portion of the seam assist device is then connected to a second connecting edge of the second portion of the seam assist device. In this manner, the first and second ends of the fabric are brought together for seaming. The seam assist device is removed by simply detaching the first and second attaching edges from the fabric.

Other aspects of the present invention include that the first and second portions may be substantially similar in dimension and the attaching edges and the connecting edges are parallel. The width of the first and second attaching edges and the first and second connecting edges may be substantially the width of the fabric. The first distance from the first end of the fabric is substantially the distance from the first attaching edge to the first connecting edge, and the second distance from the second end of the fabric is substantially the distance from the second attaching edge to the second connecting edge.

Still further aspects of the present invention include that the first and second connecting edges may be comprised of interdigitating elements which form a zipper mechanism or of VELCRO® or hook and loop type closures. The fabric to be seamed may be woven, nonwoven, spiral formed or formed preferably of a plurality of spirals and is preferably seamable on the paper machine.

The present invention will now be described in more complete detail with frequent reference being made to the drawing figures, which are identified below.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

The seam assist device according to the present invention provides a means for holding both ends of a fabric together at the seam area as a way of aligning and removing tension from the seam area to allow for easy connection and seaming. The seam assist is required to be attached to the fabric in such a way that provides strength and dependability while leaving no damage to the fabric surface after removal. This is achieved by using spiral or loop elements which are fit into voids in the surface of the fabric and anchored using a pin yarn or pintle.

Figure 3:
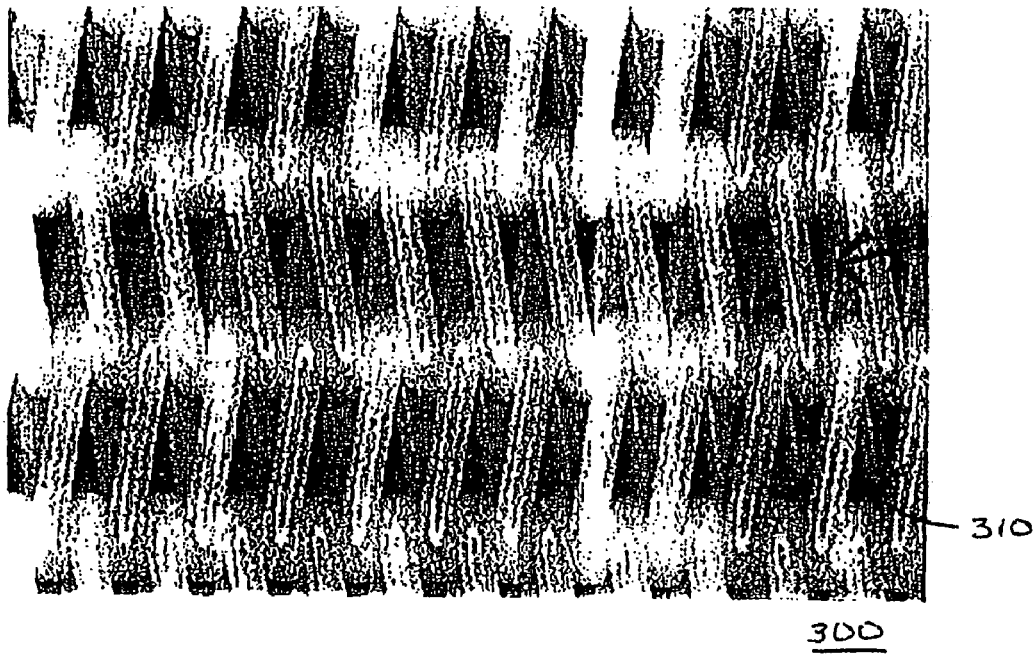
FIG. 3 is a top view of a spiral fabric showing voids across the fabric surface which are used by the present invention to attach to the fabric.

The present invention is applicable to many types of papermaking fabrics, but preferably fabrics formed of a plurality of spirals. Such fabrics may be of any type having voids which can be used to attach the assist device; including woven, non-woven, spiral formed and other types suitable for the purpose. The present invention is particularly applicable to fabrics which are seamed on the paper machine. FIG. 3 shows the surface of an exemplary spiral fabric 300 and which may be used with the present invention. Note the pattern of voids 310 across the surface. As discussed below, these voids are used when attaching the present invention to the fabric.

Figure 1:
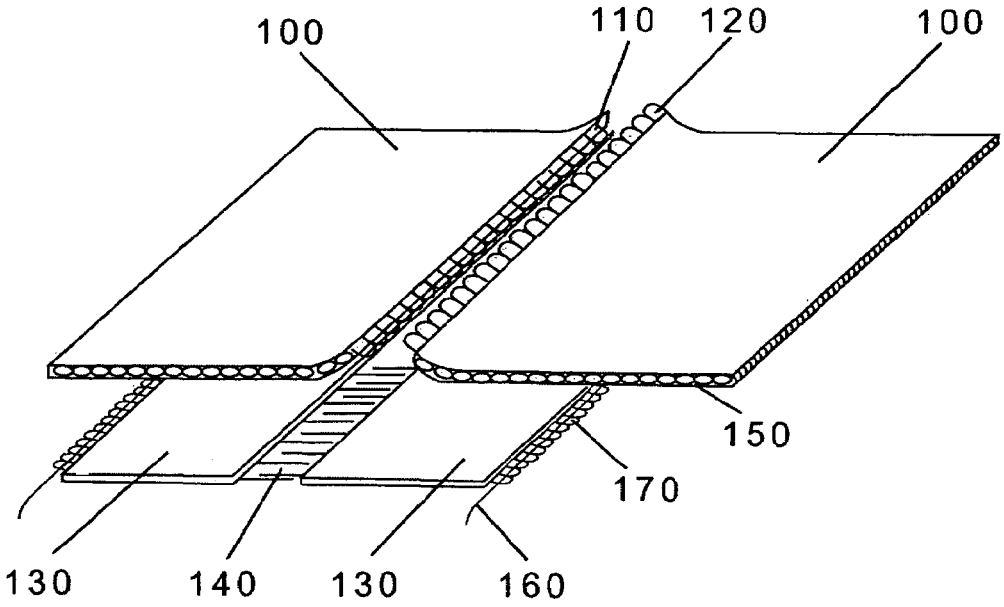
FIG. 1 is a perspective view illustrating the relationship between a seam assist device according to the present invention and a fabric to be seamed.

The preferred embodiments of the present invention will now be described by reference to FIG. 1. FIG. 1 is a perspective view illustrating the relationship between a seam assist device 130 according to the present invention and a fabric 100 to be seamed. The fabric 100 is of a type described above having voids 150 in its surface. Preferably, this fabric has been loaded onto a papermaking machine and is ready for seaming. At this point, the fabric has a first end 110 which must be seamed with a second end 120 in order to form an endless loop. Preferably, widthwise across the edges of each of the two ends are seaming loops to facilitate the seaming process. The seaming can be performed using any of the common techniques known in the art. The present invention is independent of the seaming technique used.

Also shown in FIG. 1 is the assist device 130. The assist device 130 is comprised of two pieces (each labeled 130). Each half has an attaching edge 170 and a connecting edge 140. Preferably, the assist device 130 has substantially the same width across as the fabric. This means the attaching edge will span widthwise across the entire surface of the fabric and ensures even tensioning when the device is secured. The attaching edge and the connecting edge of each piece are preferably parallel to each other. The attaching edges 170 have attached preformed loops or spiral elements widthwise along the edge for attaching to the fabric surface. A pin yarn or pintle is inserted through the loops when engaged with the fabric surface to secure the device in place. The connecting edges 140 of each portion have a connecting means for joining the halves together. The connecting means 140 may be a zipper, VELCRO®or hook and loop type material, or any other connecting means.

The assist device 130 is preferably made from a woven durable material. It can be cotton, nylon, polyester yarns or a combination thereof or other material suitable for the purpose. The yarns are preferably multifilament but can also be monofilament, plied monofilament, spun fiber, or any combination thereof. While a woven leader has been referred to, nonwoven materials, including reinforced and non-reinforced spunbonds might also be used. Knitted material can also be used. Triaxial woven material can also be used.

Figure 2:
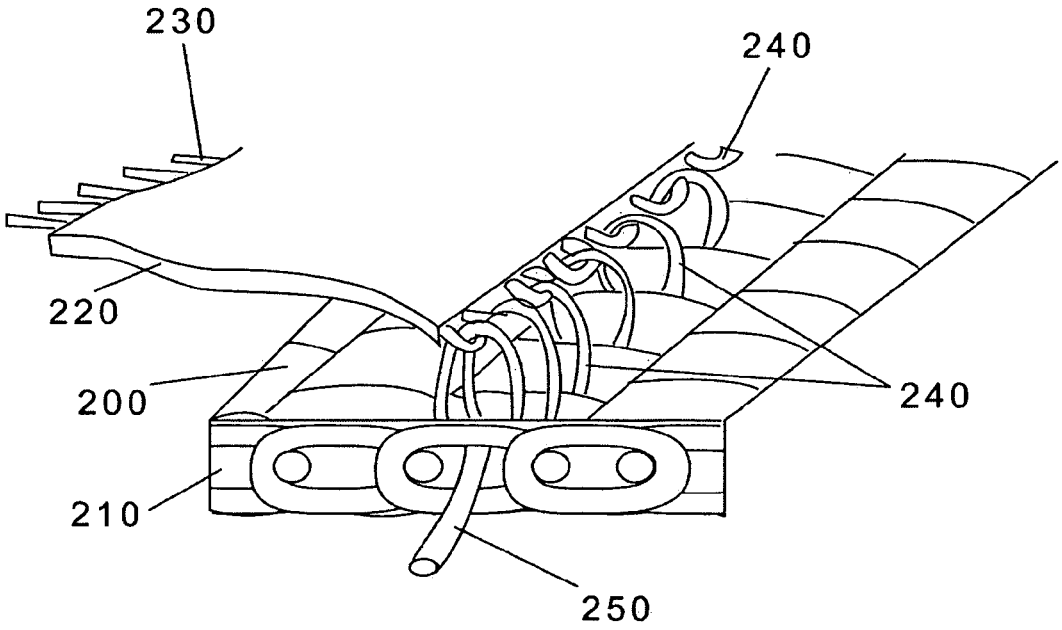
FIG. 2 is a view showing how a seam assist device according to the present invention is attached to a fabric.

FIG. 2 shows how one half 220 of a seam assist device according to the present invention is attached to a fabric 200. The half portion 220 has a connecting edge with connecting elements 230 for connecting with the other half of the device which is similarly attached to the other end of the fabric. The attaching edge 240 of the piece 220 contains attached preformed loops or spiral elements widthwise along the edge. If the device is woven, the attaching loops 240 may be integrally formed by yarns of the device, or alternatively the loops may be attached to the edge using any of the attaching methods commonly used in the art.

To attach the device to the fabric, the loops 240 are fit into the voids 210 in the fabric surface. Hence, the seam assist device is attached directly to the fabric through use of the fabric structure. In such a structure, for example a spiral fabric, the seam assist device can be attached to the surface of the fabric by means of the "spiral" or "loop" elements 240. The "spiral" or "loop" mechanisms are fitted into the voids in the spiral fabric surface. Once these elements 240 have been inserted, the loops define a passage through which a pin or pintle, a yarn-like strand or member, 250 may be directed to securely attach the edge to the surface. Hence, a pin is inserted through the intermeshed loops 240 and the fabric voids in order to anchor it in the fabric. This prevents the attaching edge from detaching from the fabric. By removing the anchoring pin, the attachment can be simply removed without damaging the fabric surface.

The attaching loops 240 can be attached to the fabric by the pin 250 as illustrated in FIG. 2 or the loops 240 can extend completely through the fabric and protrude out the back side of the fabric 200. A pin can then pass through the attached loops 240.

The pin yarn or pintle 250 can extend across the full cross-machine width of the fabric 200 or only a portion or portions thereof as long as it is sufficient enough to be effective. It should be noted that the number of attachment loops, whether they be formed of MD yarns or individual loops or spirals of the device, should be sufficient to provide the necessary strength for pulling the fabric during installation on the machine, but should not be so great as to impede the insertion of the loops into the fabric body, or of the pin yarn or pintle into (and through) such areas. Also, there does not need to be a one to one match of attachment loop to fabric void. That is, not all attachment loops need to be employed if the number of loops is greater than the number of fabric voids.

In this manner, each half of the device is independently attached near an end of the fabric. The attaching edge is preferably attached a distance from the end of the fabric that is substantially the same as the length of the portion; i.e. the distance from the attaching edge to the connecting edge of the portion. The halves are then joined/connected together. When the connecting edges of the attached portions are brought together the device will pull the two ends of the fabric into proximity of one another for seaming.

Once the fabric has been seamed, the pintle 250 may be removed from each half of the device, thereby detaching the device, with the ends of the fabric now being seamed together.

Advantageously, the seam assist device is positioned when the fabric ends are in close proximity at the seam, thereby providing greater accuracy and alignment. Also since stapling or sewing methods are not used, damage does not occur to the fabric.

Modifications to the above would be obvious to those of ordinary skill in the art, but would not bring the invention so modified beyond the scope of the present invention.

For example, if the seam assist device is made of woven fabric it may be woven in a manner to create voids to receive elements 240. These voids or crosswise unwoven bands may be formed by simply not weaving in CD yarns, or water soluble CD yarns may be woven in and later dissolved, or the CD yarns can be mechanically removed by raveling. Either way, this leaves a flat strip of fabric with woven areas to either side of the MD yarns only area. This fabric can be folded over on itself in this unwoven band and the unbound MD yarns now operate as loops. The woven ends can be sewn or stapled together and attached to zipper material. This can also be done in nonwoven fabric portions, by cutting out MD strips of material and thereby leaving MD "void" strips sandwiched between solid portions.

Alternatively, if the fabric is woven or nonwoven, fastening yarns could be anchored to the fabric in a manner set forth in for example Rydin, PCT publication WO 97/20105. The elements 240 could be coupled thereto by way of a pintles passing through elements 240 and the loops so formed with the fastening yarns. After the seam is secured, the pintles are removed.

Thus by the present invention its objects and advantages are realized and although preferred embodiments have been disclosed and described in detail herein, their scope should not be limited thereby; rather their scope should be determined by that of the appended claims.

What is claimed is:

1. A seam assist device for assisting in the seaming of a papermaker's fabric, comprising:

a first portion having a first attaching edge for attaching to the fabric in the cross-machine direction and a first distance in the machine direction from a first end of the fabric, and a first connecting edge; the first attaching edge having spiral or loop elements integral therewith or attached to loops formed thereon which are fitted into voids in or are otherwise attached to the surface of the fabric and anchored using a pin yam or pintle;

a second portion having a second attaching edge for attaching to the fabric in the cross-machine direction and a second distance in the machine direction from a second end of the fabric, and a second connecting edge; the second attaching edge having spiral or loop elements integral therewith or attached to loops formed thereon which are fitted into voids in or are otherwise attached to the surface of the fabric and anchored using a pin yam or pintle; and said first connecting edge being connectable to the second connecting edge, whereby the first and second ends of the fabric are brought together for seaming by the attached first and second portions when the first and second connecting edges are connected.

2. The device according to claim 1, wherein the first and second portions are substantially similar in dimension and the attaching edges and the connecting edges are parallel.

3. The device according to claim 1, wherein the width of the first and second attaching edges is substantially the width of the fabric.

4. The device according to claim 1, wherein the width of the first and second connecting edges is substantially the width of the fabric.

5. The device according to claim 1, wherein the first distance from the first end of the fabric is substantially the distance from the first attaching edge to the first connecting edge, and the second distance from the second end of the fabric is substantially the distance from the second attaching edge to the second connecting edge.

6. The device according to claim 1, wherein the first and second connecting edges are comprised of interdigitating elements which form a zipper-type mechanism.

7. The device according to claim 1, wherein the first and second connecting edges are comprised of hook and loop fasteners.

8. The device according to claim 1, wherein the first and second attaching edges may be detached from the fabric, thereby allowing the device to be removed after the fabric is seamed.

9. The device according to claim 1, wherein the fabric is woven, nonwoven, or is formed of spirals or loops.

10. The device according to claim 1, wherein the fabric is an on-machine-seamable fabric.

11. A method of assisting in the seaming of a papermaker's fabric using a seam assist device, comprising the steps of:

a first attaching step of attaching to the fabric a first attaching edge of a first portion of the seam assist device in the cross-machine direction and a first distance in the machine direction from a first end of the fabric; the first attaching edge being attached by fitting spiral or loop elements integral therewith or attached to loops formed thereon into voids in or are otherwise attached to the surface of the fabric and anchoring the elements using a pin yarn or pintle;

a second attaching step of attaching to the fabric a second attaching edge of a second portion of the seam assist device in the cross-machine direction and a second distance in the machine direction from a second end of the fabric; the second attaching edge being attached by fitting spiral or loop elements integral therewith or attached to loops formed thereon into voids in or are otherwise attached to the surface of the fabric and anchoring the elements using a pin yarn or pintle; and a connecting step of connecting a first connecting edge of the first portion of the seam assist device to a second connecting edge of the second portion of the seam assist device, whereby the first and second ends of the fabric are brought together for seaming.

12. The method according to claim 11, further comprising a seaming step of seaming the first end of the fabric to the second end of the fabric.

13. The method according to claim 11, further comprising a removing step of removing the seam assist device by detaching the first and second attaching edges from the fabric.

14. The method according to claim 11, wherein the first and second portions are substantially similar in dimension and the attaching edges and the connecting edges are parallel.

15. The method according to claim 11, wherein the width of the first and second attaching edges is substantially the width of the fabric.

16. The method according to claim 11, wherein the width of the first and second connecting edges is substantially the width of the fabric.

17. The method according to claim 11, wherein the first distance from the first end of the fabric is substantially the distance from the first attaching edge to the first connecting edge, and the second distance from the second end of the fabric is substantially the distance from the second attaching edge to the second connecting edge.

18. The method according to claim 11, wherein the first and second connecting edges are comprised of interdigitating elements which form a zipper mechanism.

19. The method according to claim 11, wherein the first and second connecting edges are comprised of hook and loop fasteners.

20. The method according to claim 11, wherein the fabric is woven, nonwoven, or is formed of spirals or loops.

21. The method according to claim 11, wherein the fabric is seamed on paper machine.

* * * * *